United States Patent [19]

Schiller et al.

[11] Patent Number: 4,736,609

[45] Date of Patent: Apr. 12, 1988

[54] ADJUSTING DEVICE FOR ROLLING MILL ROLLS

[75] Inventors: Günter Schiller, Kreuztal; Helmut Setzer, Siegen; Wilfried Bald, Hilchenbach, all of Fed. Rep. of Germany

[73] Assignee: SMS Schloemann-Siegmag Aktiengesellschaft, Dusseldorf, Fed. Rep. of Germany

[21] Appl. No.: 896,860

[22] Filed: Aug. 14, 1986

[30] Foreign Application Priority Data

Aug. 16, 1985 [DE] Fed. Rep. of Germany ..... 3529363

[51] Int. Cl.[4] ..... B21B 31/18; B21B 31/30; B21B 31/32

[52] U.S. Cl. ..... 72/244; 72/20; 72/21; 72/243; 72/245; 72/247

[58] Field of Search ..... 72/244, 243, 247, 245, 72/237, 20, 21

[56] References Cited

U.S. PATENT DOCUMENTS

| | | | |
|---|---|---|---|
| 1,004,771 | 10/1911 | Gibbons | 72/244 X |
| 1,971,982 | 8/1934 | Holeton | 72/247 |
| 2,075,574 | 3/1937 | Dahlstrom | 72/247 X |
| 2,729,123 | 1/1956 | Breedon et al. | 72/244 X |

FOREIGN PATENT DOCUMENTS

| | | | |
|---|---|---|---|
| 0140260 | 12/1978 | Japan | 72/244 |
| 0168714 | 10/1982 | Japan | 72/247 |
| 0110406 | 6/1984 | Japan | 72/247 |
| 0247894 | 7/1969 | U.S.S.R. | 72/244 |
| 0417193 | 2/1974 | U.S.S.R. | 72/244 |
| 1122386 | 11/1984 | U.S.S.R. | 72/244 |

*Primary Examiner*—Robert L. Spruill
*Assistant Examiner*—Steve Katz
*Attorney, Agent, or Firm*—Karl F. Ross; Herbert Dubno

[57] ABSTRACT

The rolls of a rolling mill, especially the working rolls, are horizontally shifted by a compact adjusting device, with use being made, as required, of guide pieces. The device is readily arranged in cylinder blocks, and the movements of the device can be easily monitored, transmitted, and set. The predetermined motions are carried out in rigidly controlled manner and no elastic yielding is allowed because of pressure plates extending in the windows of the base frame members. The pressure plates can be horizontally aligned and they cooperate with the holding elements which are to be shifted. The pressure plates are supported by wedges which can be shifted horizontally and transversely with respect to the plane of the frame, by way of pressure posts which operatively engage the pressure plates.

10 Claims, 3 Drawing Sheets

ADJUSTING DEVICE FOR ROLLING MILL ROLLS

CROSS REFERNCE TO RELATED APPLICATION

This application is related to the commonly assigned copending application Ser. No. 896,859 filed concurrently herewith.

FIELD OF THE INVENTION

Our present invention is related to a device for adjusting the rolls in rolling mills in a direction such that the longitudinal axis of the adjusted roll remains parallel to itself, i.e. in an axis-parallel manner.

More particularly, this invention relates to a device for shifting or setting the rolls in rolling mills in substantially parallel manner. The device is particularly intended for setting the positions of the working rolls.

BACKGROUND OF THE INVENTION

The holding pieces or elements for the driven rolls can be supported by pressure plates within the respective windows or openings of the frame members or uprights with intermediate guide pieces being provided as required. The pressure plates can be moved by actuators into the desired positions, and one pressure plate can be provided on each side of the respective roll end.

The adjusting devices are primarily useful when it is desired to change the width or profile of the nip. They are also useful in situations wherein an additional support is to be effected, for working rolls with a rather small diameter, by way of horizontal displacement in reference to the plane in which are positioned the axes of the support rolls. Such a procedure has been described in "*Herstellungvon kaltgewalztem Band* (Production of Cold-rolled Strip)", Part 1, publisher: Verlag Stahleisen mbh, Duesseldorf, 1970.

The adjusting devices must be of compact and sturdy configuration so as to be easily mounted in the window of an upright of a rolling mill stand.

The devices should also be capable of traversing precisely controllable distances, i.e. distances which can be achieved with simple and reliable means, with the control means being such that they can be operated independently, or synchronized in the same sense or in opposite senses.

Furthermore, purely translatory movements are to be carried out so that the holding elements of the rolls which need to be moved are presented with exactly positioned or aligned support surfaces.

To preclude lengthy control movements, the utilization of gearboxes or gear units has been suggested which are responsive to a rotary control movement. These units provide the respective advance by means of screw spindles and the associated nuts which threadedly engage the screw spindles.

In actual application, however, it was found that such transmissions require a disadvantageously large installation or mounting space.

Accordingly, it is generally not feasible to arrange them within the cylinder block supports which are customarily provided in the respective windows or openings of the base members.

Instead, it was necessary to arrange the piston/cylinder for carrying out the required bending and balancing, or similar control movements, in separate cylinder blocks atop and beneath the gearboxes. Attempts to lower the height of such transmissions were not successful because the requirements for sufficiently large modules and corresponding sufficiently large dimensioned gears and screw spindles could not be satisfied.

Furthermore, subdivision of the cylinder blocks is detrimental because the guide distances for the holding elements, or the pressure pieces which guide them, is limited to an undesirable extent.

OBJECTS OF THE INVENTION

It is one object of the invention to provide an adjusting device for the axis-parallel displacement of a mill roll, particularly a working roll, which overcomes the aforementioned drawbacks.

It is also an object of the invention to provide an adjusting device for rolling mills which allows an easier determination and setting of rolls in a horizontal direction perpendicular to the axis thereof.

It is also an object to provide a device for the purposes described which can be arranged in simple manner at the rolling mill frame and which can make use of conventional undivided cylinder blocks.

SUMMARY OF THE INVENTION

The foregoing and other objects and advantages of the invention are obtained in a rolling mill stand wherein the pressure plates are controlled by wedge-type adjustment devices arranged in cylinder supports or blocks which are arranged at the window-side flanks of the uprights of the rolling mill.

More particularly, use is made of undivided or substantially unitary cylinder blocks, and only one cylinder block is required at each side of the frame which is provided with a respective window. A single cylinder block is easier to install than two separate blocks and the cylinder block can provide a sufficient guide distance.

Accordingly, the adjusting device can be of relatively low height and can be very compact. Furthermore, the associated control and/or drive means can be arranged laterally in such a way that an undesirably large and additional effort is not necessary.

In accordance with a preferred embodiment, tongues form the wedge-elements of wedge shaped actuators and are provided in recesses of the cylinder blocks. These tongues are disposed parallel to the rolls, and they can be introduced in such a way into the respective cylinder block that on the wedge surfaces thereof are supported matching foot ends of pressure posts. The head ends of the pressure posts are supported at respective pressure plates. The pressure posts ensure the precise translatory movement or displacement.

In accordance with a further preferred embodiment, the cylinder blocks are equipped with piston-and-cylinder units which can be actuated by a pressure medium. These units can clamp the pressure plates, via the pressure posts, against the tongues of the wedge-shaped actuators.

This precludes any lost motion or play in the positioning of the wedges. At the same time the pressure plates are held in positions which can be clearly defined even during replacement of the rolls, for example.

For mounting of the respective drive or actuator means it has been found advantageous to provide the beams or similar support members of the frame with lateral projections which can hold the adjustment cylinders. The piston rod heads of these cylinders are directly attached to the wedge-shaped actuators.

With respect to control it has been found advantageous that the wedge-shaped actuators can be located in predetermined positions, and that a coupling is provided. Using the set position as the respective base or reference, the coupling will allow further movements with reference to a frame side only by equal and respectively countercurrently directed distance values.

It is also preferred that the respective coupling or connection is such that the two frame sides of the mill can be coupled, included in a control circuit, or interconnected for carrying out similar or related shifting movements.

In accordance with one embodiment, the coupling is by way of a mechanical transmission.

In accordance with another embodiment, the wedge-shaped actuators and/or the adjusting cylinders are equipped with sensors which effect the desired coupling to the control drives via control devices which are associated with the control drives.

Thus one can adjust, for example by way of a prior positioning, the desired free play or clearance for the guides, whereas under the effects of the respective coupling device, the subsequent control motions are carried out in countercurrent or counterreacting sense in such a way that facing pressure plates move in the same direction and by equal increments. Thus, on the one hand, the predetermined clearance will be maintained, and on the other hand, jamming is safely precluded.

In accordance with a further preferred embodiment, the tongues of the wedge-shaped actuators can contact the associated wear plates.

Moreover, it is preferred that the pressure plates are equipped with vertical guides which have stop means.

BRIEF DESCRIPTION OF THE DRAWING

The above and other objects, features and advantages of our invention, will become apparent from the following description, reference being made to the accompanying drawing in which.

SPECIFIC DESCRIPTION

Figure 1:
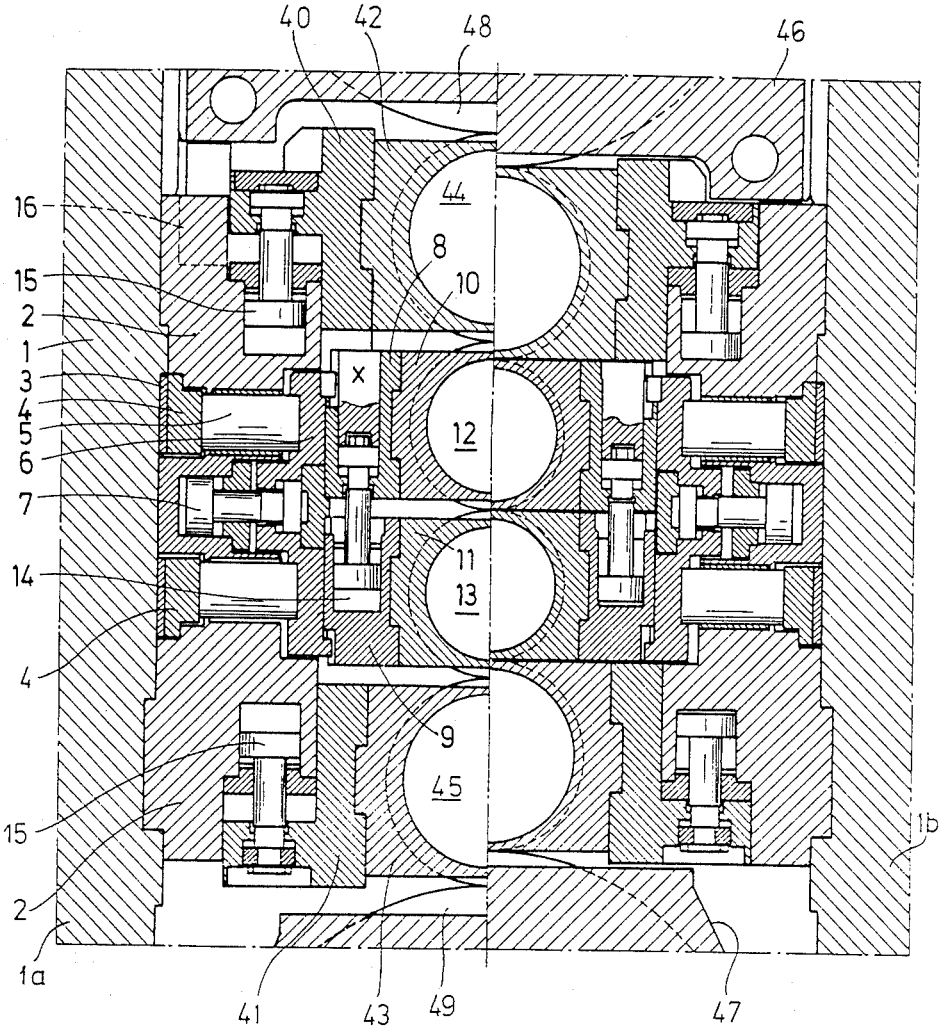
FIG. 1 is a vertical cross-section view through the central portion of an upright of a rolling mill stand.

FIG. 1 shows a six-high rolling mill stand, and particularly portions of the right upright or standard 1*a* and the left upright or standard 1*b*, or similar support members, of a rolling mill frame or stand 1. These two beam uprights are frames which define the lateral sides of a window in the frame 1, shown in detail.

Cylinder blocks 2 are mounted on the respective surfaces of the beams defining the window. The cylinder blocks 2 are formed with recesses which are lined with wear plates 3. The wear plates 3 serve to support and guide the horizontally disposed tongues 4 of a wedge-shaped actuator 17. Accordingly, the tongues can slide on the wear plates 3.

In this embodiment, the inwardly directed surfaces of the tongues 4 are horizontally inclined at an angle of 4° with respect to the vertical.

Figure 2:
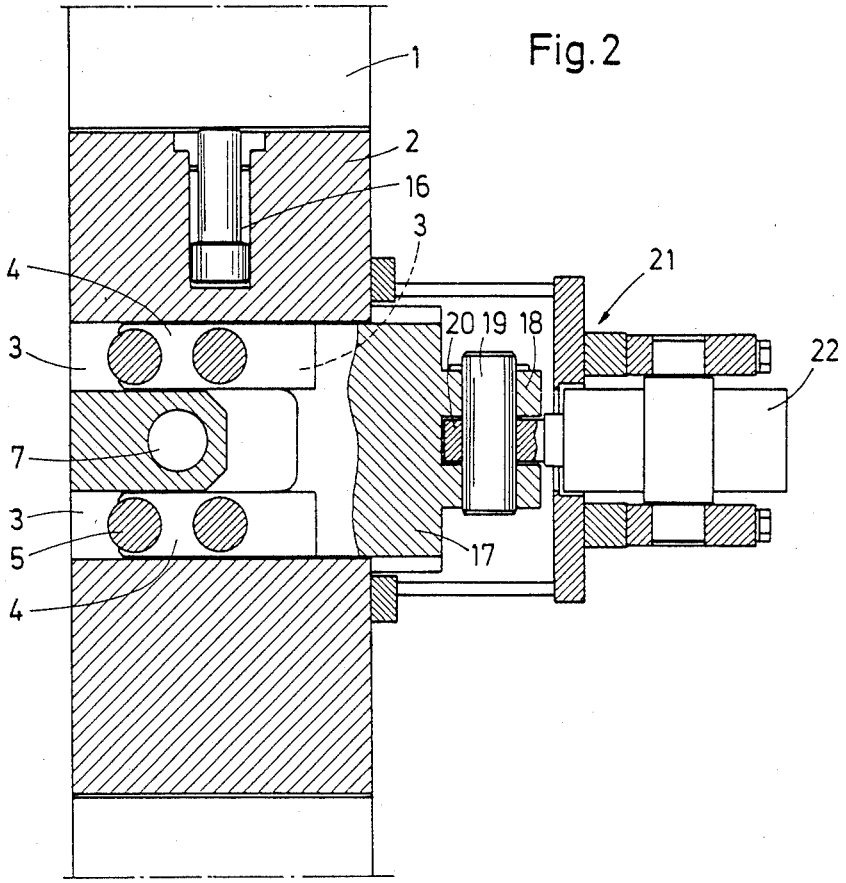
FIG. 2 is vertical cross-section view along the plane between the tongues and the pressure posts.

Four cylindrical pressure posts 5 are respectively associated with a pair of tongues 4, compare FIG. 2. The base surfaces or foot ends of these pressure posts 5 are guided on the tongues 4, and they have a similar inclination (4°). The opposite or head ends of the pressure posts 5 have generally planar surfaces, and these are in operative contact with the respective pressure plate 6.

For each pressure plate 6, the cylinder blocks 2 respectively include a piston-and-cylinder unit 7, cylinder 7 hereinafter, which is operated by a pressure medium. The cylinder 7 serves to tension or clamp the pressure plate 6 in the outward direction and in the direction of the wear plates 3. Accordingly, the pressure plate 6 is supported in the frame 1 by way of the pressure posts 5, the tongues 4 of actuator 17, and the wear plates 3.

An upper vertically movable intermediate guide piece 8 and a lower vertically movable guide piece 9 are respectively arranged in vertical guides, e.g. grooves, of the pressure plates 6. The intermediate guide pieces 8 and 9, in turn, serve to guide and support, by way of horizontal guide elements, e,g, grooves, dovetail guides or the like, the mounting or holding elements 10 and 11 of the working rolls 12 and 13, respectively. By means of vertically disposed hydraulic piston-and-cylinder units 14, hydraulic cylinders 14 hereinafter, the intermediate guide pieces 8 and 9 and their respective holding elements 10 and 11 can be tensioned with respect to one another and, accordingly, the working rolls can be balanced or adjusted. For example, the cylinder chamber of cylinder 14 can be provided in the guide piece 9, and its piston is then secured in the intermediate guide piece 8, as is shown in FIG. 1.

Accordingly, actuation of the cylinder 14 will separate or bring together the working rolls 12 and 13 in conformity with the movements of the piston because movements of the intermediate guide pieces 8 and 9 will cause corresponding movements of the holding elements 10 and 11. This is schematically indicated in FIG. 1 by a gap between the holding elements 10 and 11 to the left side of the centerline, whereas the holding elements 10 and 11 are shown in contact with one another on the right side. The associated components, of course, will carry out and/or allow the respective movements.

The working rolls 12, 13 as represented at 51 can be provided with hydraulic cylinders for shifting them axially. For details of such a mechanism see the above identified application Ser. No. 896,859 which is hereby incorporated in its entirety by reference.

Further hydraulic piston-and-cylinder units 15 and 6, hydraulic cylinders 15 and 16 hereinafter, are also arranged in the cylinder blocks 2. The cylinders 15 and 16 serve to achieve tensioning or securing of the associated guide pieces and/or the holding elements of the associated support rolls.

Thus an upper guide piece 40 and lower guide piece 41 are respectively arranged with corresponding formations in vertically disposed guide elements, e.g. grooves, dovetails recesses or the like, of the cylinder block 2. The guide pieces 40 and 41, in turn, control the movement of the holding elements 42 and 43 for the intermediate rolls 44 and 45, by being respectively arranged with corresponding formations in horizontally disposed guides, e.g. recesses, dovetail grooves or the like formations. Only portions are shown of the upper holding element 46 and the lower holding element 47 for the outer support rolls 48 and 49, respectively. These components are operated in analogous manner.

FIG. 2 shows a cross-sectional view parallel to the longitudal axes of the rolls through one of the cylinder blocks 2 at the level of the interface surface between the tongues 4 of the actuator 17 and the axis of the hydraulic cylinder 16.

The four pressure posts 5 can be seen with respect to which the pressure medium cylinder 7 is arranged symmetrically and/or in the center of the respective diagonals. The two tongues 4 of the actuator 17 are joined at the right side in the drawing into a clevis 18 which is attached to the head 20 of a piston rod of a hydraulically actuated piston-and-cylinder unit 22, cylinder 22 hereinafter. The clevis 18 and the head 20 are formed with matching bores into which a connecting pin 19 is introduced.

A laterally projecting formation or the like support 21 is provided at the respective vertical beam of frame 1 and this serves for mounting the pivoting hydraulic piston-and-cylinder unit 22, hydraulic cylinder 22 hereinafter. It is preferred that the cylinders 22 are double acting units.

Figure 3:
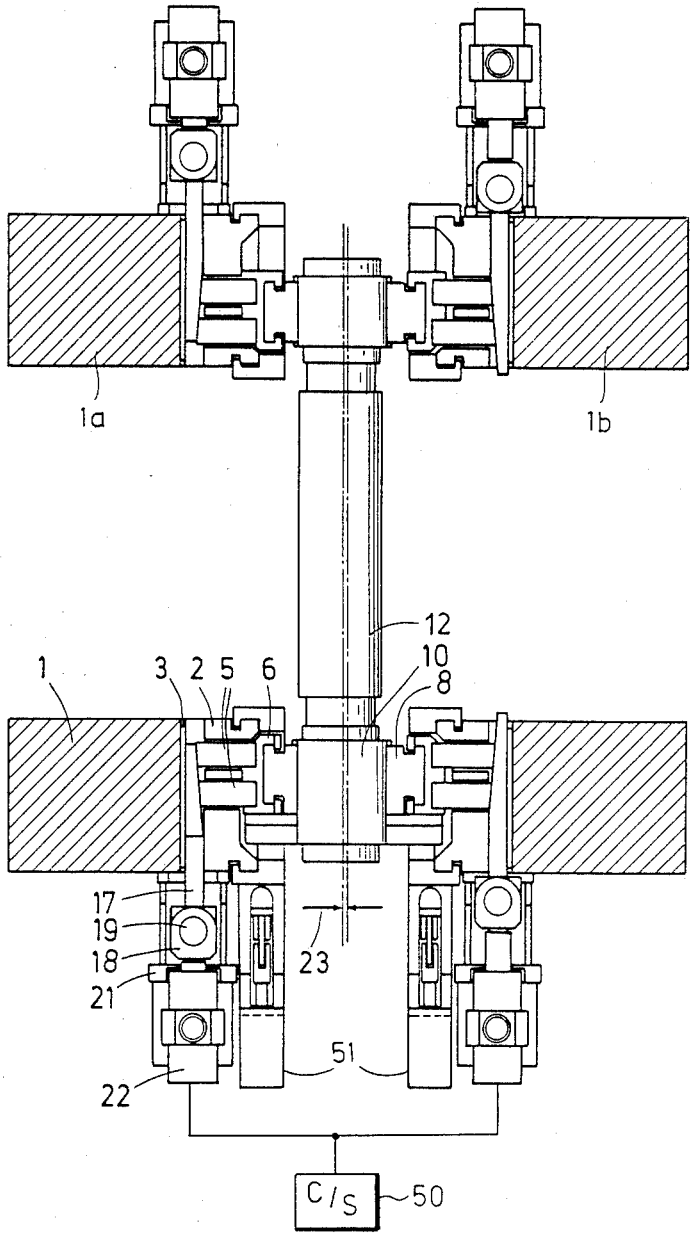
FIG. 3 is a horizontal cross-section view through the stand at a level of the upper working roll.

Corresponding components are shown in the horizontal section in FIG. 3, which is taken through the two vertical beams 1*a* and 1*b* of the frame 1, to show, on the one hand, the four actuators 17 and, on the other hand, the vertical guides for the guide pieces 8 (and 9).

For operation or adjusting, the hydraulic cylinders 22 are operated in such a way by a control and/or switching device 50 that the associated actuators 17 are moved, each with its tongues 4.

When the tongues 4 are moved in this way and penetrate more deeply along the wear plates 3 into the cylinder blocks 2, the pressure posts 5 are moved and they, in turn, move the associated pressure plate 6; but this action is carried out against the force of the respective cylinder 7.

In order to simplify the operation, the device is preferably equipped with a control or switching device 50 including control drive means as desired.

In the starting position, the oppositely arranged actuators 17 of one side of the frame 1, say the lower portion shown in FIG. 3, can be adjusted in such a way that their guide pieces 8 and 9, and the holding elements 10 and 11 (9 and 11 not seen) which are embraced thereby, have the optimal clearances or degree of free play.

During the subsequent operation, the movements of the working rolls 12 and 13 are achieved in such a way that the respectively oppositely arranged wedges or actuators (4, 17) are moved in countercurrent or counteracting mode.

Thus, with reference to FIG. 3, in order to achieve a desired movement or shifting of the working rolls 12 and 13 out of the shown plane of symmetry to the left by the distance indicated with the double-headed arrow 23, the actuator 17 shown on the left in the lower part of the drawing sheet is retracted, whereas the other (right) actuator 17 is deeper advanced into and somewhat out of the window. Thus, the two associated pressure plates 6 are moved through the same distance to the left, and the clearance or free play already set is maintained.

The actuators 17 shown in the upper part of the drawing are operated in like manner in the support of frame 1, with the left actuator 17 being retracted, whereas the right actuator 17 is introduced deeper into the window in order to here again achieve the same distance value of displacement or movement to the left of the holding elements (9,10).

Preferably these movements are pre-set and automatically controlled. Thus, the cylinders 22, or respectively the piston rods and/or the actuators 17 are equipped with sensors or the like indicators which trigger the respective elements of the control/switching device 50. These sensors are known in the art and need not be described or shown in detail for an understanding of the invention.

For example, one of the cylinders 22 can be pressurized in controlled manner, whereas the others follow the respective controlled motions.

For carrying out the adjusting motions, it is also prefered to pre-set the control command in all control elements (control/switching device 50) and to maintain these in synchronized or related operation.

Thus in any event there is provided a compact adjusting device which is afforded sufficient space in the respective window to accommodate the cylinder blocks 2 and its associated cylinders. By the proper selection of the inclination of the wedge members, 4 in the discussed embodiment, one can achieve the desired adjusting motion with the effective advance of the actuators (17).

As desired, there remains the option to design the control device in such a way that also the pre-set inclination or position of a working roll during the advance is effectively maintained. This, in turn, allows the desired variability of the adjustment for the working rolls without using a split or divided cylinder block, and the horizontal forces which are produced by working rolls are directly introduced into the vertical beams and the like supports of the frame 1.

Because the lengths of the cylinder blocks 2 need not be unduly limited, sufficiently long guides are available for the guide pieces of the holding elements.

Hitherto, conventional smaller pressure-medium cylinders which are effective between the holding elements or pieces and the guide pieces, respectively, of which at least two were necessary, are now replaced by a single larger cylinder. Accordingly, an enhanced securement of the limits or stops of the working roll exchange is achieved.

The option is available that in the case of a solid cylinder block 2 use is made of hydraulic passages which are provided by bores rather than using additional pipes or the like conduits.

In the embodiment the adjusting device is shown in a six-high rolling mill.

However, the invention is applicable in other rolling mills such as five-high, four-high, three-high or even two-high rolling mills.

In accordance with a further variation, the wedge-shaped tongues 4 have continuously inclined surfaces, and the associated serially arranged and supported pressure posts 5 have different lengths, in conformity with the inclination and distance.

In commercial application other members and/or arrangements of the pressure posts 5 can be selected, and the pressure posts 5 can also be arranged with such spacing, or in such rows, that they are of uniform length. The respective wedge surfaces are then divided into corresponding partial wedges.

Thus, the rolls of the rolling mill, especially the working rolls 12 and 13 can be horizontally shifted in the direction of rolling in defined and reproducible manner, compacting adjusting device including actuators 17 and tongues 4, with use being made, as required, of guide pieces 8 and 9. The device is readily arranged in cylinder blocks 2, and the movements of the device can be easily monitored, transmitted, and set. The predetermined motions are carried out in rigidly controlled manner and no elastic yielding is allowed because of pressure plates 6 extending in the windows of the frame 1. The pressure plates 6 can be aligned horizontally, and they cooperate with the holding elements 10, 11 which are to be shifted. The pressure plates 6 are supported by wedges or tongues 4 which can be shifted horizontally and transversely with respect to the plane of the frame, by way of pressure posts 5 which operatively engage the pressure plates 6.

We claim:

1. A rolling mill stand comprising:

a pair of uprights formed with respective windows, having inwardly facing vertical surfaces;

a respective cylinder block at least partly received in each of said windows and provided with longitudinal recesses on opposite sides opening toward said surfaces, said cylinder blocks each being provided with an opening flanked by the said opposite sides of each cylinder block;

a respective pair of superposed bearing blocks received in and horizontally movable in each of said openings;

a pair of working rolls disposed one above another received between said uprights, each of said working rolls having opposite ends each journaled in a respective bearing block of each of said pairs for rotation about respective roll axes;

a respective pair of wear plates braced against a respective one of said surfaces at a respective recess and having said inwardly turned faces in each of said cylinder blocks;

a respective pair of horizontally spaced pressure plates in each of said cylinder blocks flanking a respective pair of said bearing blocks, said pressure plates being slidably movable horizontally perpendicular to said axes to shift a respective one of said bearing blocks horizontally perpendicular to said axes;

respective wedge-shaped elements extending and guided horizontally parallel to said axes and each sliding along a respective one of said wear plates in the respective cylinder block;

a plurality of parallel cylindrical pressure posts assigned to each of said elements, and interposed between each wedge-shaped element and the respective pressure plate while being spaced apart in a direction of displacement of said elements shifting each of said pressure plates horizontally perpendicular to said axes upon displacement of said elements; and at least one hydraulically actuated piston-and-cylinder unit located in each of said cylinder blocks parallel to said axes and connected with respective ones of said wedge-shaped elements for displacing said wedge-shaped elements.

2. The rolling mill defined in claim 1 wherein each of said pressure posts has an inclined surface at one end for contacting the respective wedge-shaped element and a surface, parallel to said axes at an opposite end of the respective pressure post for contacting the respective pressure plate.

3. The roll-mill stand defined in claim 2 wherein each end of said inclined surfaces has an inclination of 4° to said axes.

4. The roll-mill stand defined in claim 1 wherein each of said hydraulically actuated piston-and-cylinder units is positioned symmetrically with respect to said plurality of pressure posts on each side of the respective cylinder block.

5. The roll-mill stand defined in claim 1 wherein said wedge-shaped elements on each side of the respective cylinder block are joined at one end at a clevis coupled with the respective unit.

6. The roll-mill stand defined in claim 1, further comprising means coupling the piston-and-cylinder units of each of said cylindrical blocks for synchronized movement.

7. The roll-mill stand defined in claim 6 wherein the coupling means is a mechanical coupling.

8. The roll-mill stand defined in claim 1 wherein said wedge-shaped elements have respective inwardly facing surfaces forming an angle of 4° with said axes.

9. The roll-mill stand defined in claim 1, further comprising another piston-cylinder unit located in each of said cylinder blocks coupled to each pressure plate for drawing it away from the respective bearing blocks.

10. The roll-mill stand defined in claim 9 where in the wedge elements on each side of a respective cylinder block flank the respective other piston-and-cylinder unit.

* * * * *